US006543200B1

(12) United States Patent
Panzarella et al.

(10) Patent No.: US 6,543,200 B1
(45) Date of Patent: Apr. 8, 2003

(54) ROBOTIC CRATE FASTENING SYSTEM

(75) Inventors: Vincent J. Panzarella, Greenfield, WI (US); Robb W. Roloff, Pewaukee, WI (US)

(73) Assignee: ABB Inc., New Berlin, WI (US)

( * ) Notice: Subject to any disclaimer, the term of this patent is extended or adjusted under 35 U.S.C. 154(b) by 126 days.

(21) Appl. No.: 09/670,202

(22) Filed: Sep. 25, 2000

(51) Int. Cl.[7] ..... B65B 7/28; B65B 57/00

(52) U.S. Cl. ..... 53/75; 53/52; 53/64; 53/138.1; 53/329

(58) Field of Search ..... 53/75, 138.1, 138.2, 53/329, 52, 64; 227/2, 5, 7, 41

(56) References Cited

U.S. PATENT DOCUMENTS

| | | | | | |
|---|---|---|---|---|---|
| 2,695,705 | A | | 11/1954 | Powers et al. | |
| 3,796,339 | A | | 3/1974 | Suzuki | |
| 4,013,168 | A | | 3/1977 | Bamburg et al. | |
| 4,019,635 | A | | 4/1977 | Boots | |
| 4,435,028 | A | | 3/1984 | Rivkin | |
| 4,639,996 | A | * | 2/1987 | Fullmer | 29/407.02 |
| 4,815,343 | A | * | 3/1989 | Sofinowski | 81/57.37 |
| 4,869,136 | A | * | 9/1989 | Easter et al. | 81/55 |
| 4,887,016 | A | * | 12/1989 | Malick | 700/253 |
| 4,990,839 | A | * | 2/1991 | Schonlau | 318/568.15 |
| 5,104,024 | A | | 4/1992 | Brewer et al. | |
| 5,358,397 | A | * | 10/1994 | Ligon et al. | 156/244.11 |
| 5,411,130 | A | * | 5/1995 | Noestheden | 198/457.07 |
| 5,626,231 | A | | 5/1997 | Kwong et al. | |
| 5,823,349 | A | | 10/1998 | Bridges | |
| 6,060,853 | A | * | 5/2000 | Rongo et al. | 318/568.16 |

FOREIGN PATENT DOCUMENTS

| | | |
|---|---|---|
| JP | 59-73245 | 4/1984 |

* cited by examiner

*Primary Examiner*—John Sipos
*Assistant Examiner*—Louis Huynh
(74) *Attorney, Agent, or Firm*—Ryan Kromholz & Manion, S.C.

(57) ABSTRACT

A device for and method of robotically crating objects, such as consumer goods, being capable of securing an upstanding enclosure to a recyclable pallet having structural uprights. The device conveys a pallet and enclosure assembly into a work station, installs a number of threaded fasteners into predetermined locations in the top and two adjacent sides of the assembly, rotates the assembly one-hundred eighty degrees, installs fasteners into the two remaining sides, rotates the assembly back to the initial position, and conveys the secured crate assembly out of the work station. The device includes the ability to detect the number of times a recyclable pallet has been used, and to adjust the exact locations of fasteners accordingly, thereby assuring that new fasteners are always installed into an unused fastener location.

8 Claims, 20 Drawing Sheets

ROBOTIC CRATE FASTENING SYSTEM

BACKGROUND OF THE INVENTION

The present invention relates generally to the field of crating and palletizing objects, such as consumer goods, in shipping boxes, and specifically to a device capable of securing an upstanding crate to a recyclable pallet having structural uprights.

Near the end of a manufacturing conveyor line, finished product is often secured to pallets and crated for shipping. U.S. Pat. No. 5,823,349 describes a shipping container comprising a wooden base, a corrugated cardboard box that fits over the base, reinforcing material applied to the box adjacent to the base, and a plurality of fasteners which fasten the box to the base through the reinforcing material. While the described invention is a good system for attaching a cardboard crate to a wooden base, it provides little structural integrity and may collapse under a moderate overhead load. Shipping containers are typically stacked and sometimes require a high degree of structural rigidity.

The present invention makes use of highly rigid structural uprights attached to the pallet which help support loads from all sides, as well as provide for additional fastener locations.

Traditionally, the task of securing the product and crate enclosure to the pallet has been carried out manually. The repeated emotions of manual labor can become tedious, and depending on the size of the crates, such tasks can also become strenuous. Continued crating and moving of such containers can cause injury to workers. Further, depending on the output speed and configuration of the conveyor line, multiple workers may be required to properly palletize and crate the product.

In an effort to reduce workforce size and injury costs, there has been a significant move toward automating this process by utilizing robots. As is known in the art, industrial robots may be fitted with various "end of arm tools" or "end-effectors" to accomplish different tasks, including driving fasteners into a connecting medium.

Robots have some advantages over human workers, such as being able to work continuously for days or weeks, while at the same time virtually eliminating human error. However, robotic arms lack the mobility of a human workforce. Due to a limited range of motion, a typical robot can only reach one or two sides of a container. Multiple robots have been needed to secure fasteners in all required locations. The present invention employs a turntable that rotates the container, thereby allowing a single robot to complete the entire task.

After the enclosure is properly fastened to the pallet, the container is ready for shipping. When it reaches the "point of sale and delivery" destination, the pallet and enclosure are usually discarded. In the case of a distributor or retailer who receives a high volume of product, the vast amount of shipping materials creates disposal problems. Some dealers have even turned to burning the combustible materials because of the resources required to store and ship away the large amounts of refuse.

Disposing of the shipping materials can also be very wasteful. The pallet is usually well built to provide a stable platform for supporting the product and moving the container. Some large or heavy products make use of a metal pallet, which are more difficult to dispose of than those made of wood. Metal pallets are relatively more expensive than other shipping materials, and should be used multiple times to boost efficiency.

Reusing the shipping pallets requires some regulation to ensure they are still capable of providing an adequate supporting platform and secure fastening surface. The present invention employs a method of identifying said pallets before use in a way that allows the device to physically detect whether the pallet is still usable.

SUMMARY OF THE INVENTION

According to the present invention, the foregoing and other objects and advantages are attained by providing an apparatus or device capable of conveying a pallet and enclosure assembly into a work station, detecting if the pallet is usable, installing a number of fasteners in predetermined locations, and conveying the finished container out of the work station.

The process begins by manually securing a product to the pallet. This can be done in one or more ways, such as attaching straps to the pallet that wrap around said product. Next, one or more rigid U-shaped uprights are inverted and placed into pre-existing slots in the pallet. A bottomless cardboard enclosure is then lowered over the pallet, enclosing said product and said uprights.

The entire pre-loaded crate assembly may be brought to the work station by an infeed conveyor. The conveyor has pallet usage sensors that recognize how many times the current pallet has been used before, and photoeye sensors that detect the physical size of the incoming crate. This information is sent to the robot's computer for calibration of the fastening sequence.

The pre-loaded container is delivered by an infeed conveyor to a turntable, where it is rotationally aligned to receive fasteners. The robot end-effector is equipped with at least one automatic screwdriver that receives threaded fasteners from a feeder mechanism. The preprogrammed robot and its screwdriver install said fasteners through the cardboard crate into the pallet and rigid uprights.

Because the robot has a limited range of motion, fastener installation is preferably accomplished in stages. The robot first inserts fasteners through the top of the crate into the rigid upright(s), then inserts fasteners on two adjacent sides of the container, into either the upright(s) or the pallet, depending on the preselected fastener location. The turntable then rotates the container 180° so the robot can install fasteners into the two remaining sides. When this stage of robot activity is completed, the turntable reverses back to its original position. A conveyor then moves the finished container off the turntable and onto an exit conveyor. If any faults had been detected during the robot's fastening operation, a label is placed onto the container as it leaves the work station indicating that a manual inspection and correction is required.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
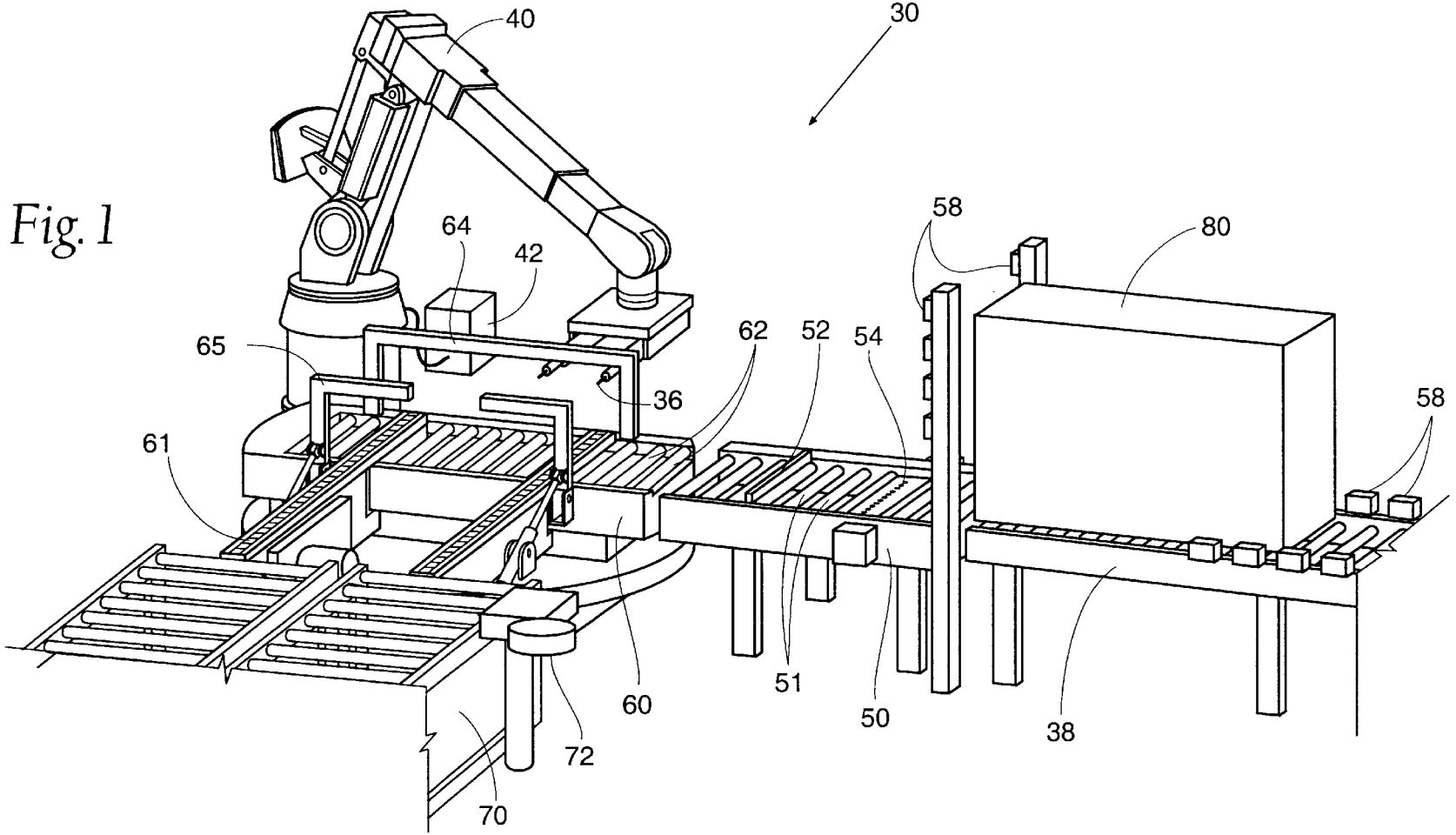
FIG. 1 is a perspective view of the present invention.
Figure 2:
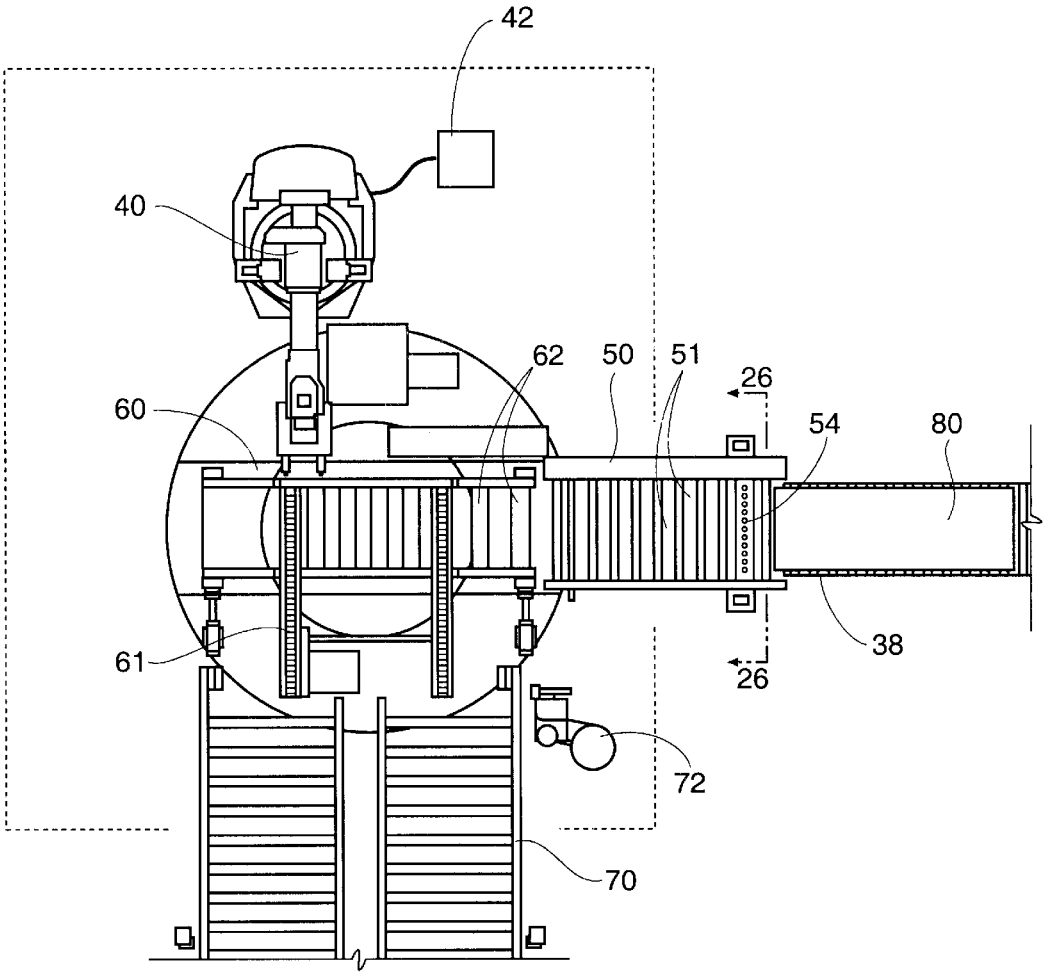
FIG. 2 is a top plan view of the present invention.
Figure 3:
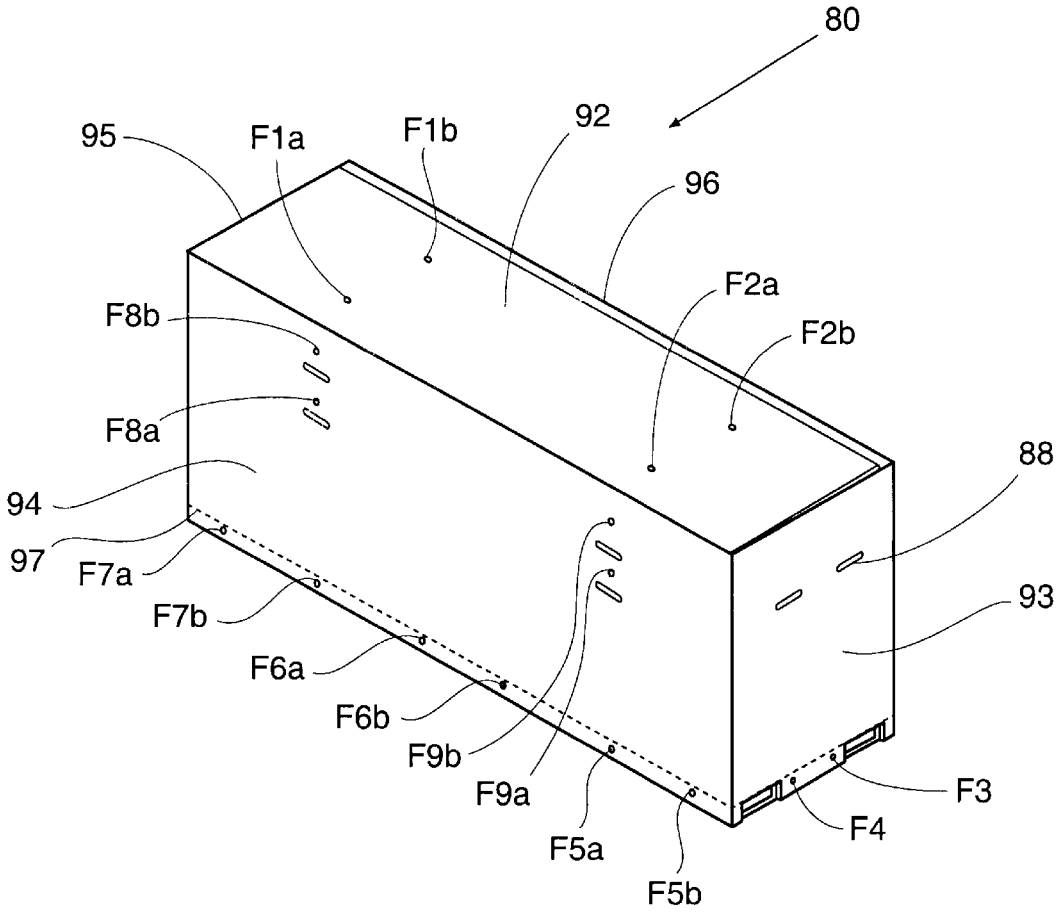
FIG. 3 is a perspective view of the present crate assembly.

With reference to FIGS. 1–3, inclusive, the present invention comprises a robotic crate fastening cell 30 for crating and palletizing objects. In brief, the apparatus includes a pre-loaded crate assembly 80, an infeed conveyor 50, a turntable 60, a robot 40, a robot control system 42, and an exit conveyor 70. A conventional programmable logic controller (PLC) or similar device controls the operation, receiving information from and giving instructions to the various components in the correct order.

The crate assembly 80 is fed onto the turntable 60 by the infeed conveyor 50. A plurality of fasteners are installed into the top 92, a first end 93 and first side 94 of the crate assembly 80 by the robot 40. The crate assembly 80 is then rotated 180 degrees around its central vertical axis by the turntable 60. A plurality of fasteners are installed into second end 95 and second side 96 of the crate 80. The turntable 60 then rotates the crate 80 back to the original position, and the crate assembly 80 exits the cell 30 via the exit conveyor 70.

FIG. 3 depicts a typical crate assembly 80 and shows one example of fastener locations. Of the twenty-eight total locations in this particular configuration, sixteen are visible in FIG. 3, specifically, four in the top 92 (F1*a*, F1*b*, F2*a*, F2*b*), two in the first end 93 (F3, F4) and ten in the first side 94 (F5*a*, F5*b*, F6*a*, F6*b*, F7*a*, F7*b*, F8*a*, F8*b*, F9*a*, F9*b*). Two more (locations F10 and F11 being shown in FIG. 17) are located in the second end 95, while ten more (locations F12*a*–F16*b*, inclusive, being shown in FIG. 18) are located in the second side 96. Individual fastener locations, such as "F1*a*," identified in FIG. 3 will be referred to later in this description. Fastener location terminology will also be described below.

Figure 4:
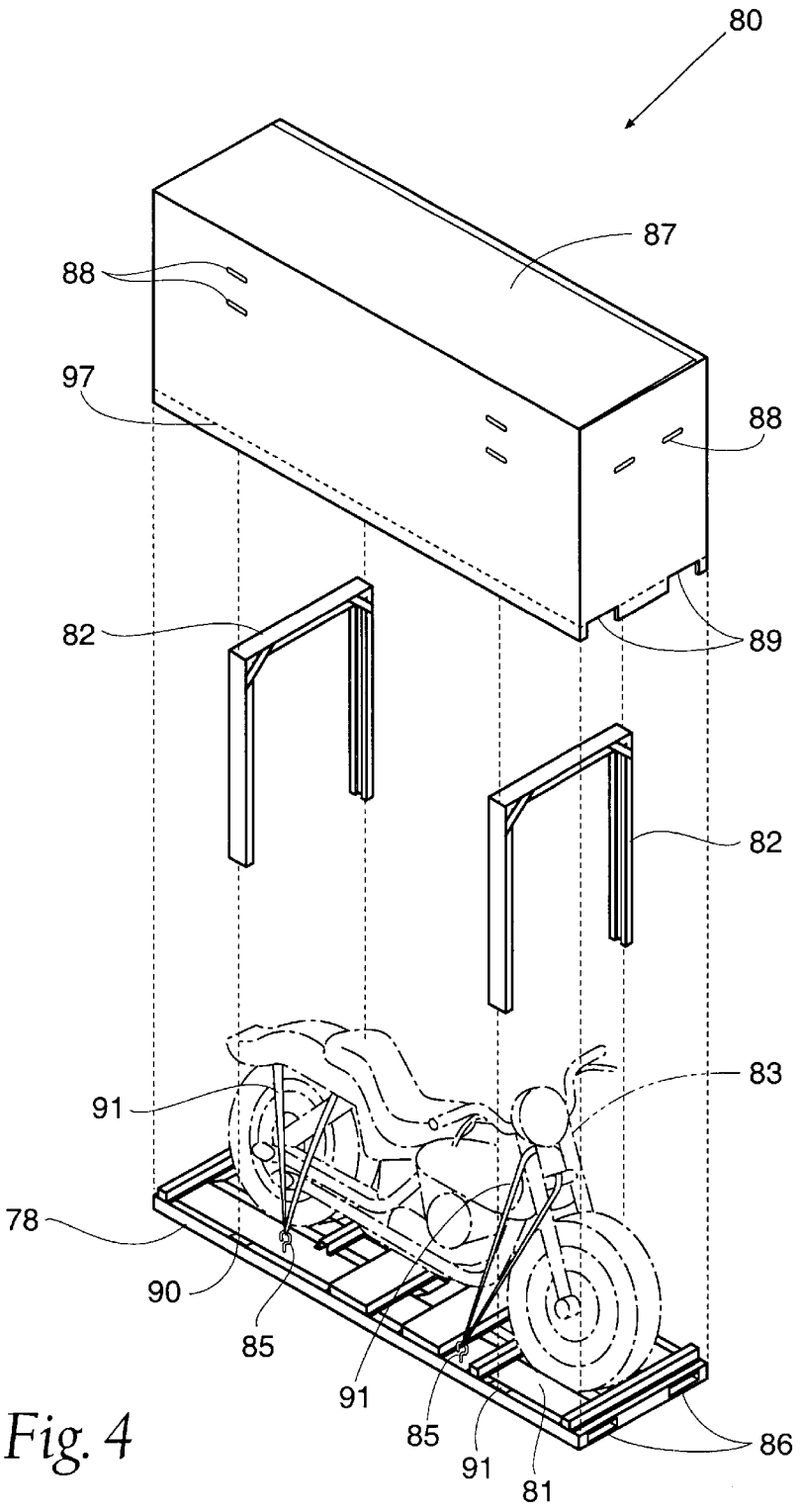
FIG. 4 is an exploded view of the present crate assembly.
Figure 5:
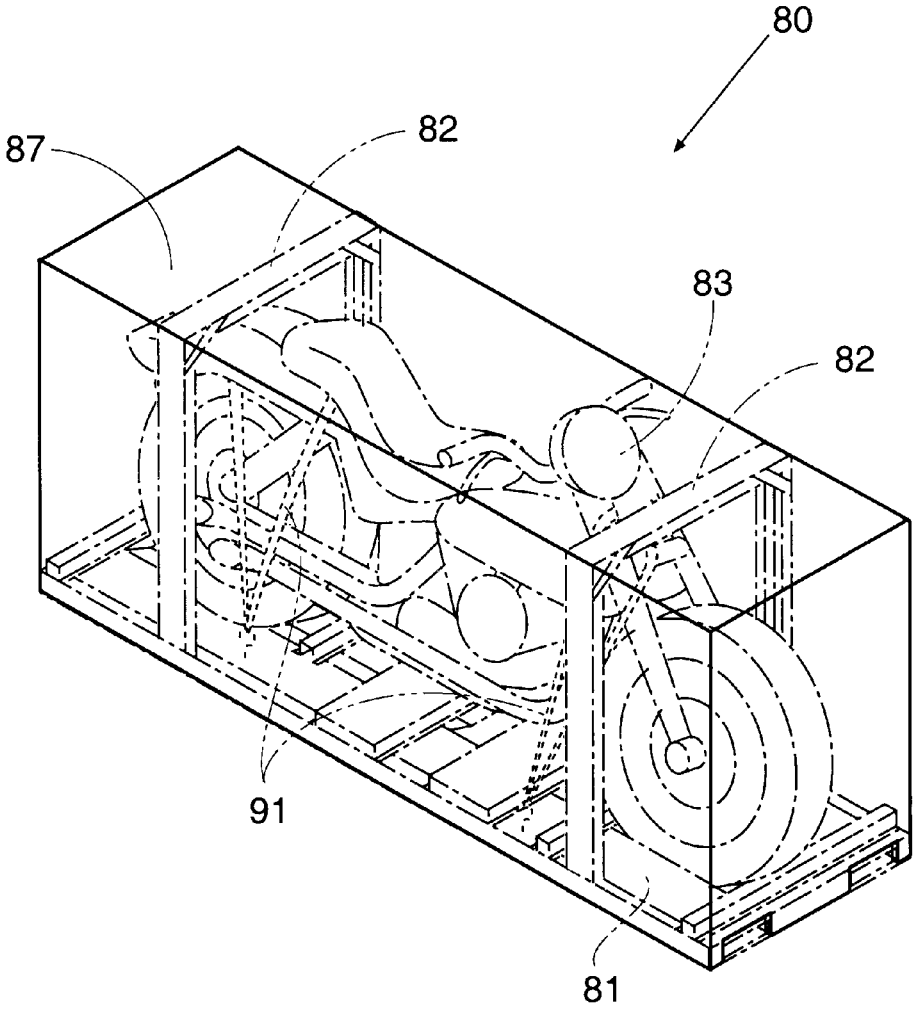
FIG. 5 is a perspective view of the present crate assembly with all components visible.

Now referring to FIGS. 4 and 5, the crate assembly 80 comprises an object 83 to be crated, a pallet base 81, one or more structural uprights 82, and an enclosure or container 87. The object 83 is placed on the supporting platform 99 of the pallet base 81 and secured to prevent shifting. The present method of securement includes tying down the object 83 using straps 91 affixed to eyelet holes 85 in the pallet base 81. Structural uprights 82 are then placed into receiving slots 90 in the pallet base 81. The structural uprights 82 will eventually provide vertical support to allow stacking of finished crate assemblies during shipping.

The enclosure 87 is lowered over the uprights 82, object 83 and pallet base 81 to form the crate assembly 80. A marginal fastening area 97 of the enclosure 87 overlays a fastening surface 78 of the pallet base 81. A plurality of handgrip openings 88 may be formed in the enclosure 87, and may be placed to allow manual or visual confirmation that the structural uprights 82 are correctly in position. Lift openings 86 in the pallet base 81 and enclosure slotted end portions 89 allow the crate assembly 80 to be carried by a conventional forklift vehicle to and from the robotic cell 30.

Figure 6:
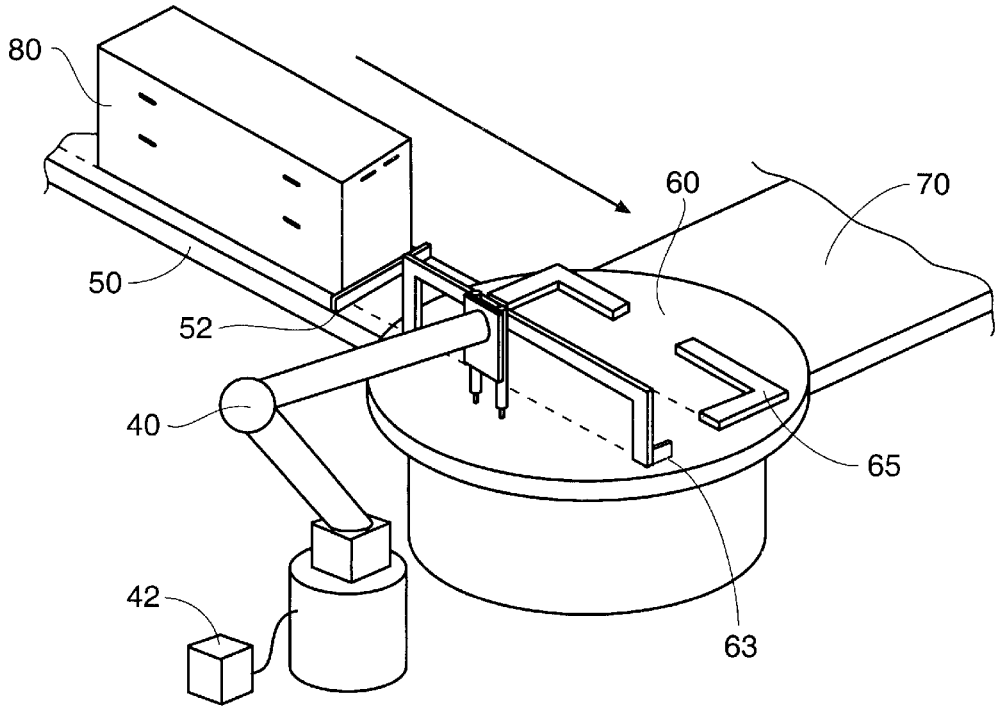
FIG. 6 is a perspective view depicting the present invention as the crate assembly enters the work area.

The pre-loaded crate assembly 80 may be brought manually or via forklift to the infeed conveyor 50, and set on an incoming storage conveyor 38, as shown in FIG. 1. A plurality of infeed rollers 51 begin rotation, thereby conveying the crate assembly 80 until it rests against a popup stop 52 at the location depicted by FIG. 6. The crate assembly 80 is then checked for both physical size and previous usage of the pallet base 81. This information is electronically transmitted to the robot control system 42, and is used to calibrate the robot 40 for the immediate crate assembly 80, as the present invention is capable of operating on crate assemblies of various sizes, and of reusing pallet bases 81 a predetermined number of times. One or more photoeye sensors 58 (see FIG. 1) determine the physical height and length of the crate assembly 80, while the pallet usage sensor 54 determines the number of times that the pallet base 81 has been previously used. Operation of the pallet usage sensor 54 and the effects of its findings will hereinafter be discussed.

Once the needed information is ascertained, the popup stop 52 is retracted and the infeed rollers 51 and turntable rollers 62 convey the crate assembly 80 onto the turntable 60. When the crate assembly 80 clears the popup stop 52, the infeed rollers 51 stop and the popup stop 52 returns to its original position. The crate assembly 80 is moved until it rests against a fixed stop 63 (see FIG. 6) on the turntable 60, wherein the turntable rollers 62 shut off. The crate assembly 80 is now in position to receive fasteners from the robot 40.

Figure 7:
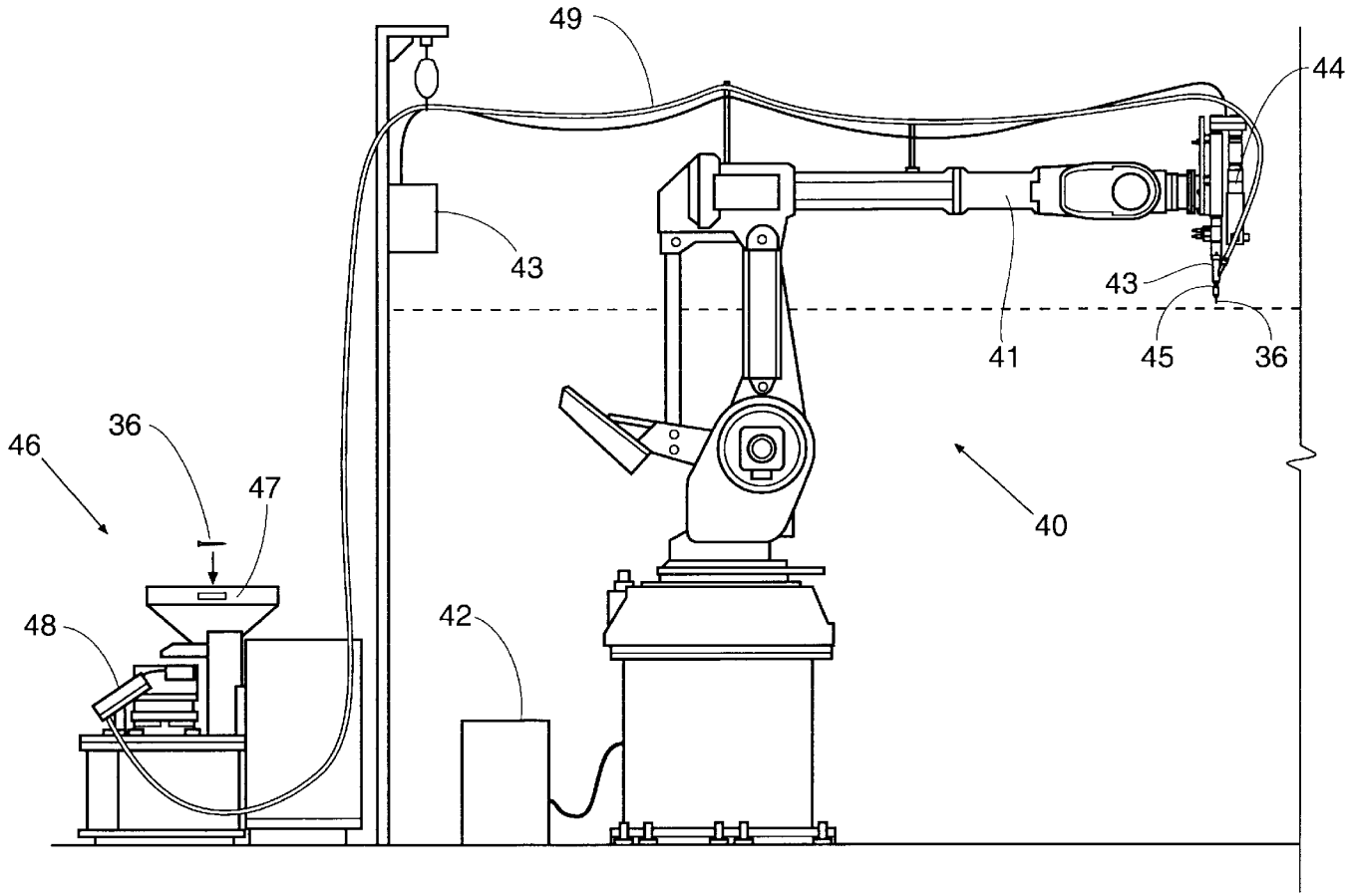
FIG. 7 is an elevational side view depicting the robot and fastener supply system.
Figure 8:
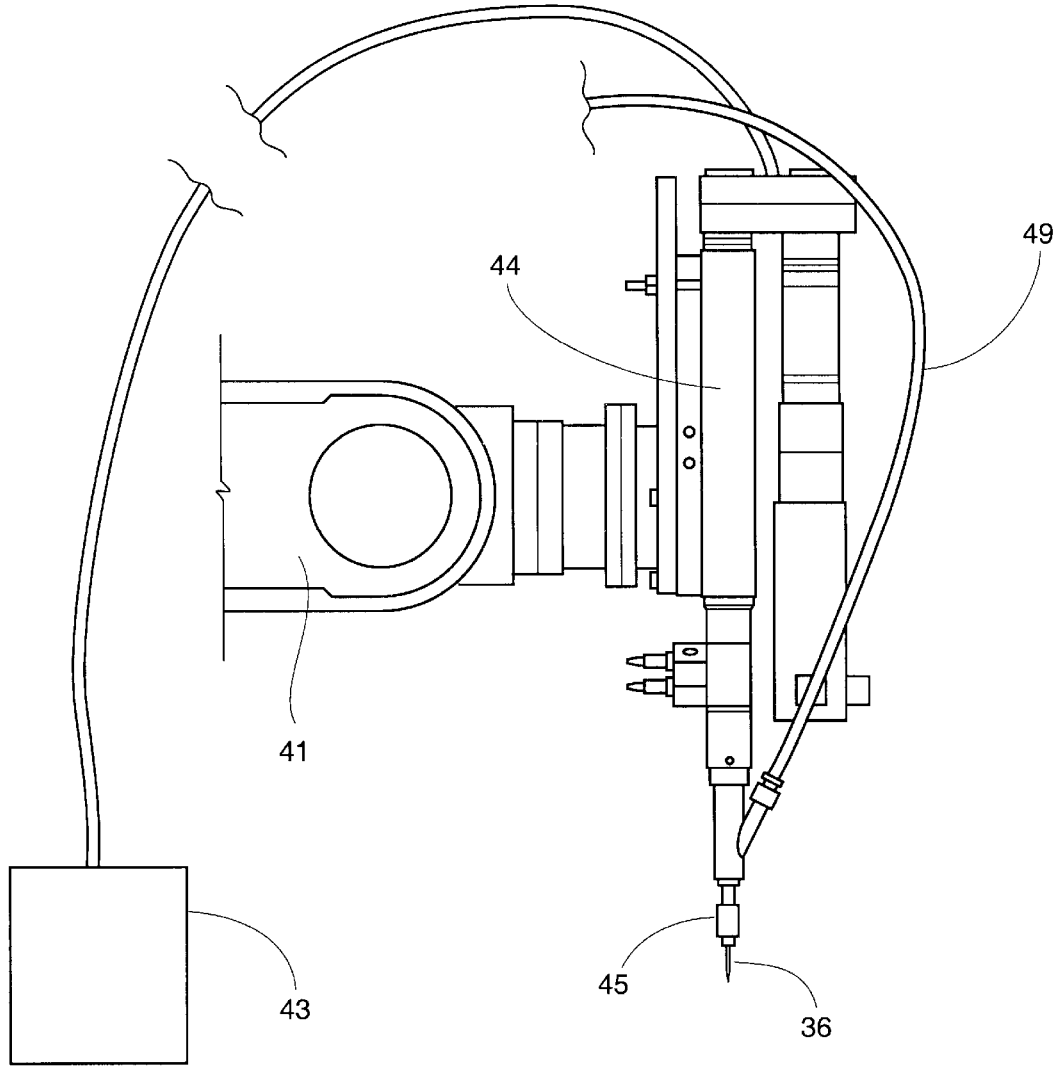
FIG. 8 is a side elevational view depicting the robotic end-effector of the present invention.

With specific reference to FIGS. 7 and 8, in the preferred embodiment, the robot 40 comprises a six-axis robot arm 41 equipped with an end-effector 44 having one or more pneumatic screwdrivers 45, each screwdriver 45 being arranged to receive threaded fasteners 36 from a vibratory bowl feeder system 46. In the present embodiment, the end-effector includes two Weber screwdrivers, each having its own SureTork controller 43 and vibratory bowl feeder system 46. Threaded fasteners 36 are stored in vibratory feeder bowls 47 and are released from an air-operated escapement 48. The fasteners 36 are conveyed by air pressure through a feed tube 49 and delivered into the end-effector 44. As the fasteners 36 are installed into the crate assembly 80, the SureTork controllers 43 monitor the torque applied to each fastener and the degrees of rotation of each fastener. If the fastener torque does not reach a certain minimum, or if the number of rotational degrees recorded is too high or too low, a fastener failure is detected and, upon ejection from the robotic cell, the crate assembly 80 will be labeled for inspection.

In our preferred embodiment, the robot is an IRB6400/2.3-120 model manufactured by ABB of Sweden. The preferred pneumatic screwdrivers are commonly referred to as Weber screwdrivers and are manufactured by Weber Screwdriver of Kisco, N.Y.

Figure 9:
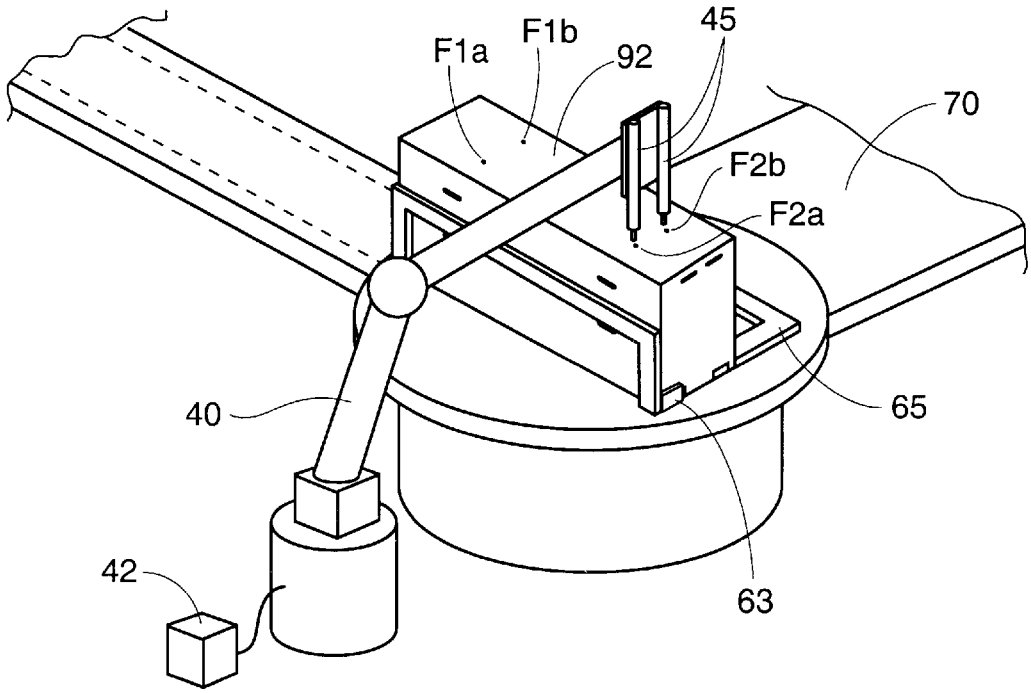
FIGS. 9 through 12 are perspective views depicting the present invention during various stages of operation.

As depicted in FIG. 9, the robot 40 begins fastener installation by installing four fasteners 36 through the top 92 of the crate assembly 80 and into the top rail of the structural uprights 82. Because the preferred end-effector 44 has two screwdrivers 45, the robot need only stop in two positions, installing two fasteners simultaneously at each position. It should be apparent that one or multiple end-effector tools may be used without departing from the present invention. Multiple robots 40 could also be employed.

Herein, fastener locations will be identified by the letter "F," followed by a number that corresponds to the stop position of the robot while installing those fasteners. The stop position number may range from 1 to 16, as there are a total of sixteen robot stop positions in which fasteners are installed. This designation may be followed by reference letters "a" or "b" to identify between the two possible fastener locations at each robot stop position.

The robot 40 stops at its first position and installs fasteners F1*a* and F1*b* through the enclosure 87 and into a structural upright 82. The robot 40 then moves to a second position (as depicted in FIG. 9) and drives fasteners F2*a* and F2*b* through the enclosure 87 and into the other structural upright 82.

Figure 10:
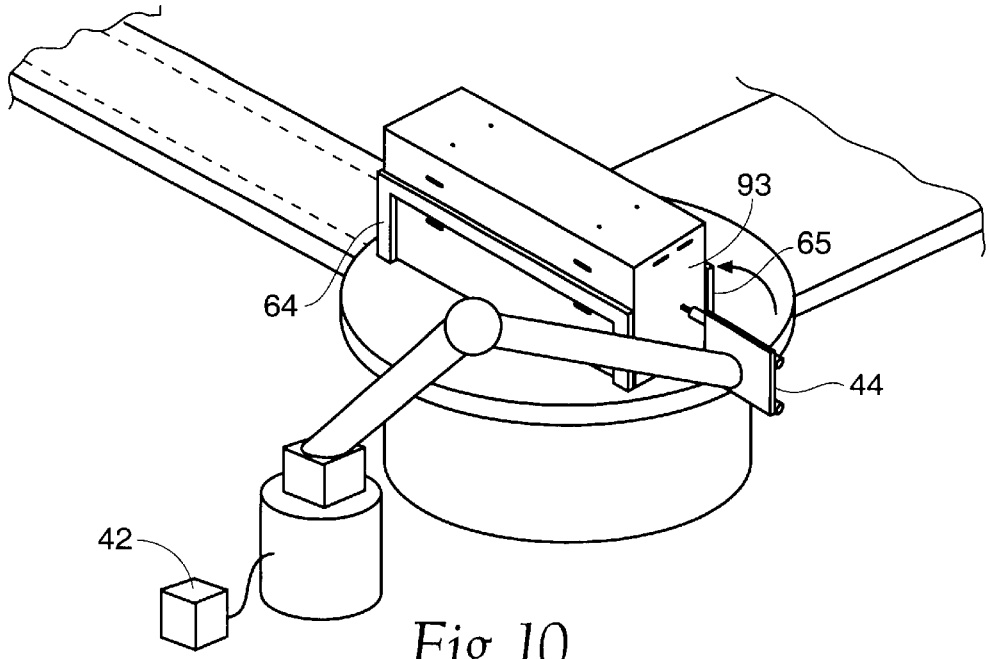
Figure 11:
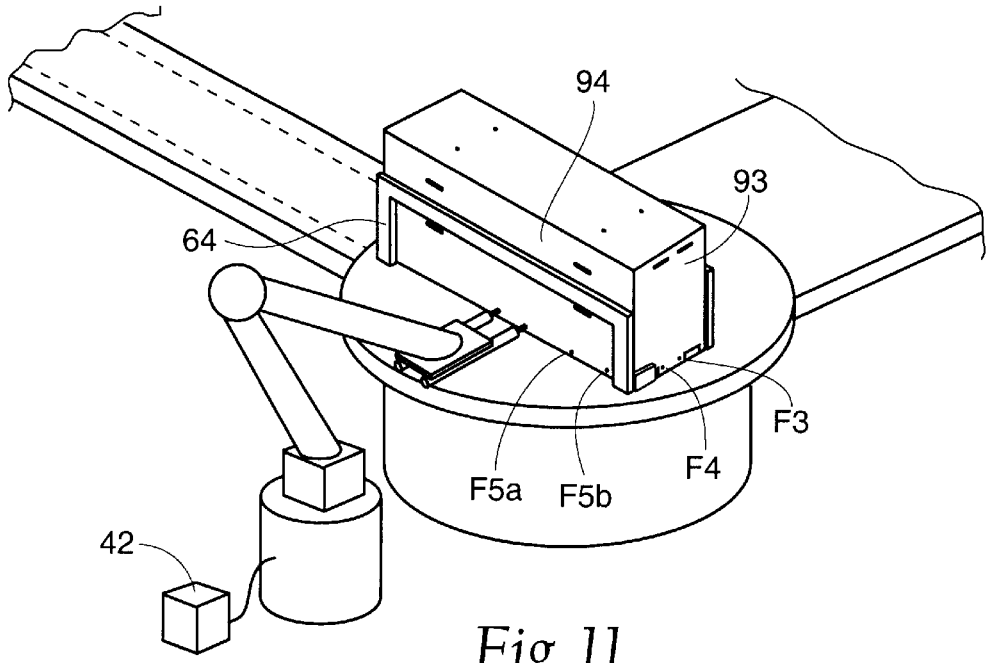

Next, referring to FIGS. 10 and 11, stabilization clamps 65 are actuated, thereby clamping the crate assembly 80 against the stabilization bar 64, supporting the crate assembly 80 against the pressure of fastener insertion and preventing the crate assembly 80 from being skewed horizontally. The robot positions along the first end 93 of the crate assembly 80 and installs a single fastener F3 through the enclosure 87 and into the pallet base 81, as depicted in FIG. 10.

A single fastener is used at this stop position because there is no rigid fastening surface behind the enclosure 87 above the pallet base 81. Next, the robot 40 moves a short lateral distance to the fourth stop position and installs fastener F4 on the first end 93 of the crate.

It is conceivable, and within the purview of the invention, that fasteners F3 and F4 could be installed simultaneously using the preferred end-effector 44. However, fasteners F3 and F4 may not be installed simultaneously if, as in the present case, the distance between the two fastener locations differs from the distance between the two screwdrivers 45 on the end-effector 44.

The robot 40 next swings around to the first side 94 of the crate assembly and into a fifth stop position, and installs fasteners F5*a* and F5*b*, both of which pierce the enclosure 87 and pallet base 81. Fastener F5*a* also passes through a structural upright 82, thereby securing the upright 82 to the pallet base 81.

FIG. 11 depicts the robot 40 in the sixth position, installing fasteners F6*a* and F6*b* through the enclosure 87 and into the pallet base 81. The robot then moves farther down the first side 94 of the crate assembly 80 and installs fasteners F7*a* and F7*b* in similar fashion, with fastener F7*b* passing through a structural upright 82. Reference to FIG. 3 may be helpful for showing the locations of these fasteners.

Figure 12:
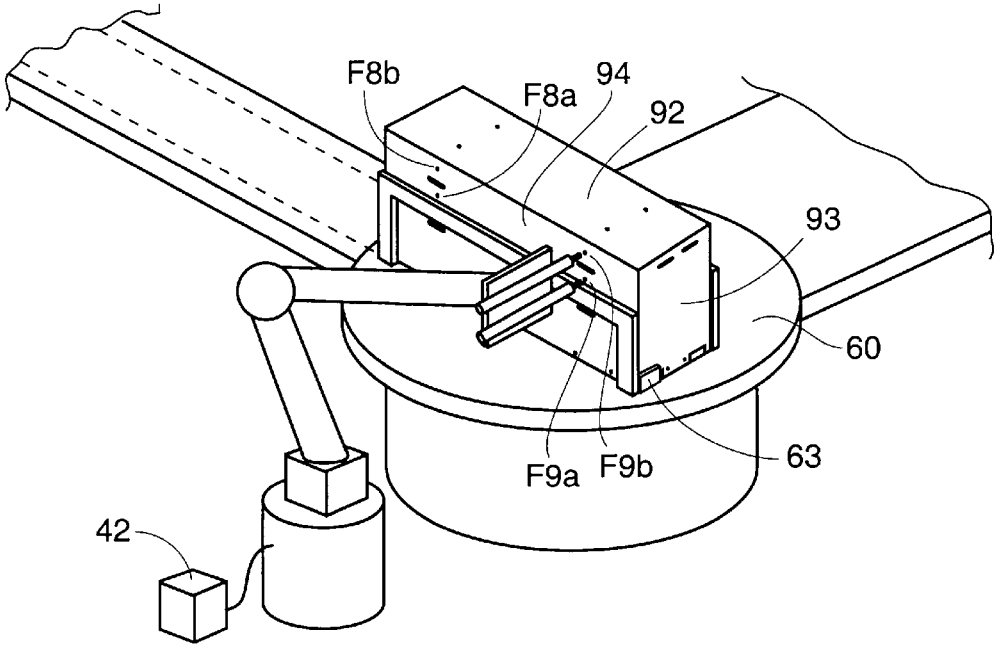

With reference to FIG. 12, the robot 40 now rotates the end-effector 44 ninety degrees, placing the two screwdrivers vertically relative to one another. At the eighth position, fasteners F8*a* and F8*b* are driven into the upper half of the first side 94, through the enclosure 87 and into one structural upright 82. Fasteners F9*a* and F9*b* are installed in similar positions into the other upright 82. Again, FIG. 3 may be a useful reference for location of the fasteners. The robot 40 is now finished installing fasteners into the top 92, first end 93 and first side 94 of the crate assembly 80, and moves clear of the turntable 60.

Figure 13:
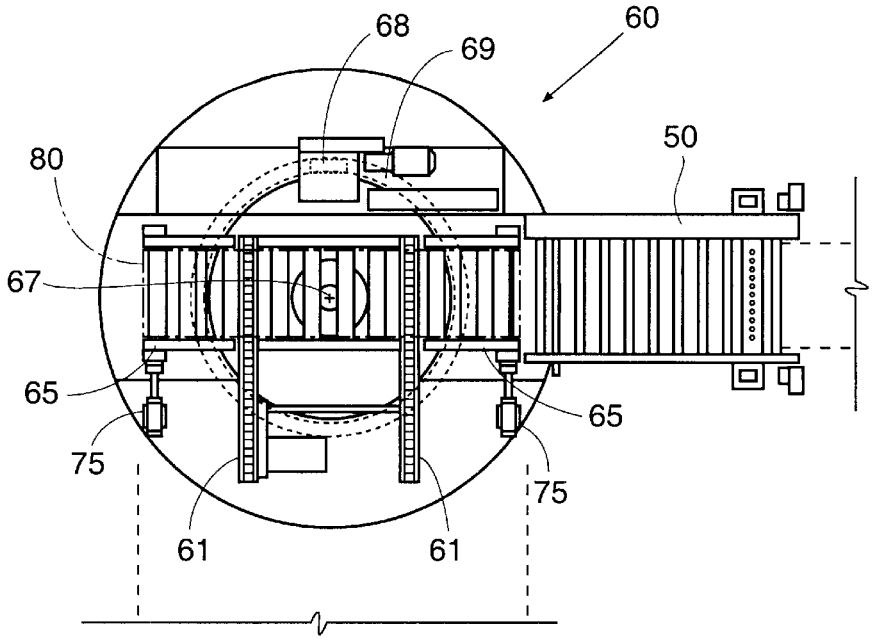
FIG. 13 is a top plan view of the turntable assembly.
Figure 14:
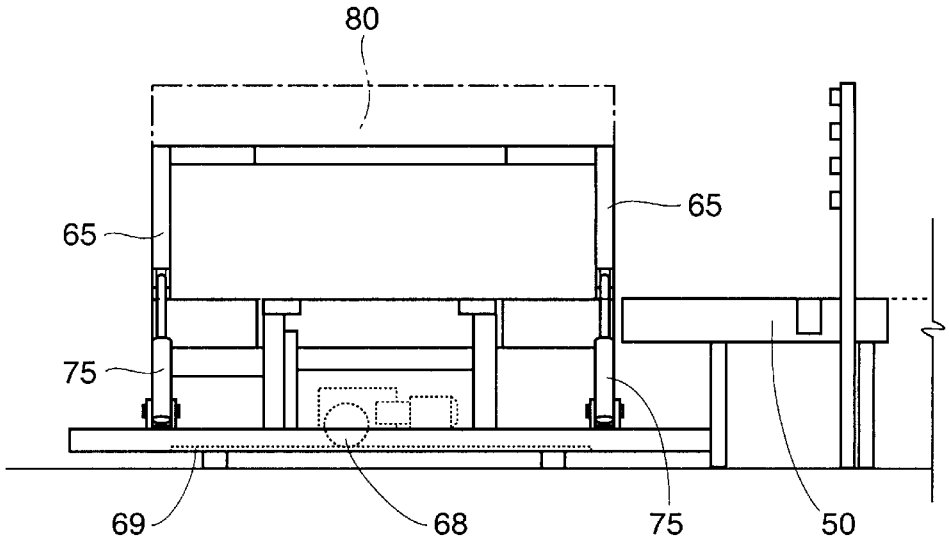
FIG. 14 is a front elevational view of the turntable assembly.

The turntable 60, which supports the crate assembly 80, is depicted in FIGS. 13 and 14. Rotation is accomplished by a single drive wheel 68 set in a stationary track 69. As the wheel 68 turns, the upper portion of the turntable 60 rotates about a central pivot point 67. FIGS. 13 and 14 also depict the stabilization clamps 65 and an actuator 75 attached to each. As the actuator 75 extends or retracts, the stabilization clamp 65 raises or lowers. A lift chain conveyor 61 is also shown, and is later used to convey the crate assembly 80 off of the turntable 60. In our preferred embodiment, the turntable 60 is manufactured by Lauyans & Company of Louisville, Ky.

Figure 15:
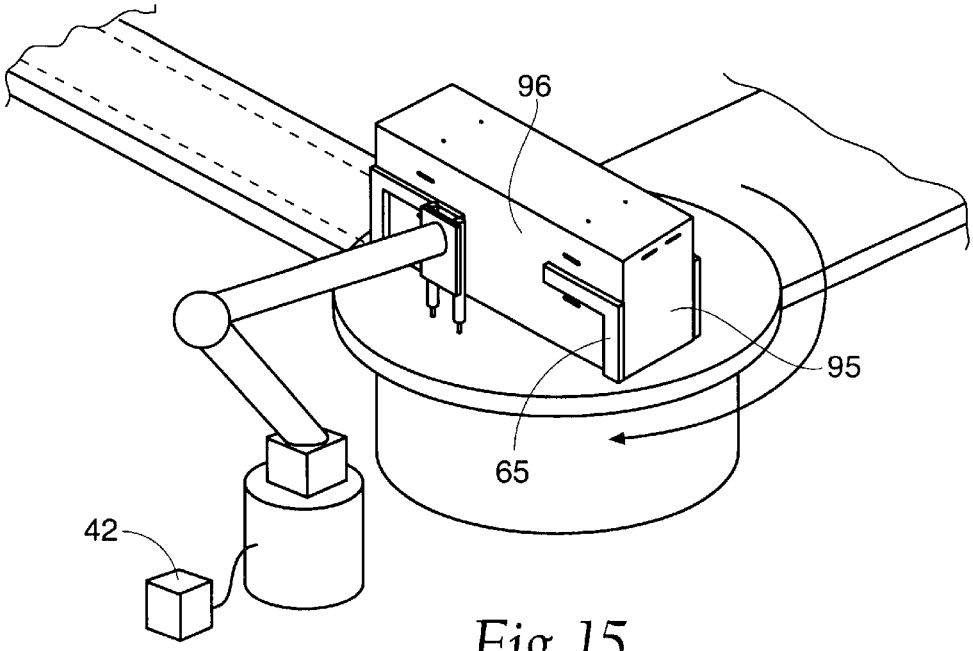
FIGS. 15 through 19 are perspective views depicting the present invention during various stages of operation.
Figure 16:
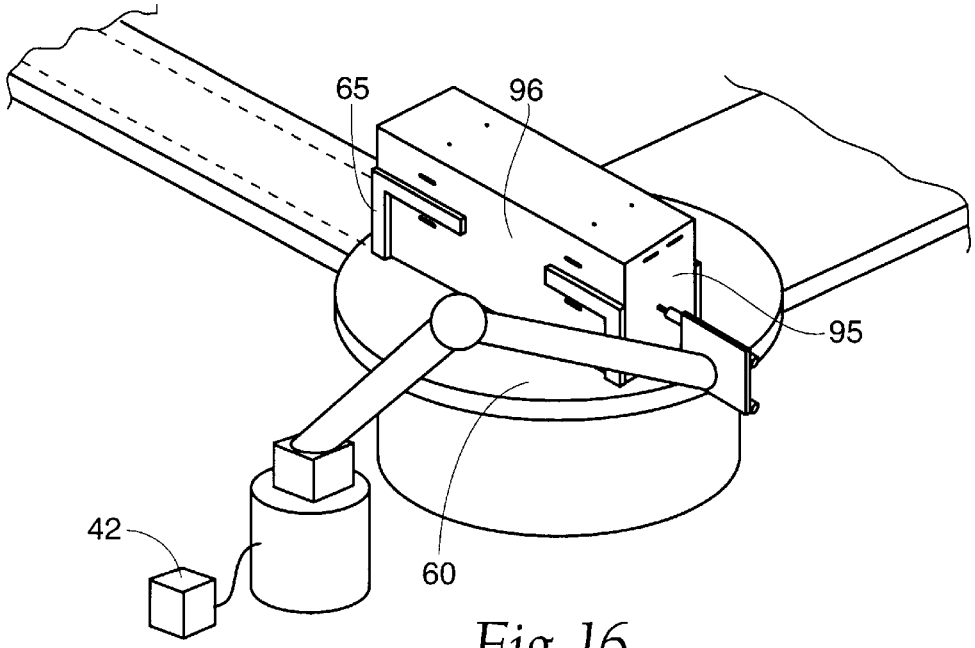

FIG. 15 depicts the robot 80 in a clear position and the turntable 60 rotated to allow installation of the remaining fasteners into the second end 95 and second side 96 of the crate assembly 80. The robot installs fasteners F10 and F11 into the second end 95 in the same manner as fasteners F3 and F4 into the first end (see FIG. 16, showing the robot 40 in the eleventh stop position).

Figure 17:
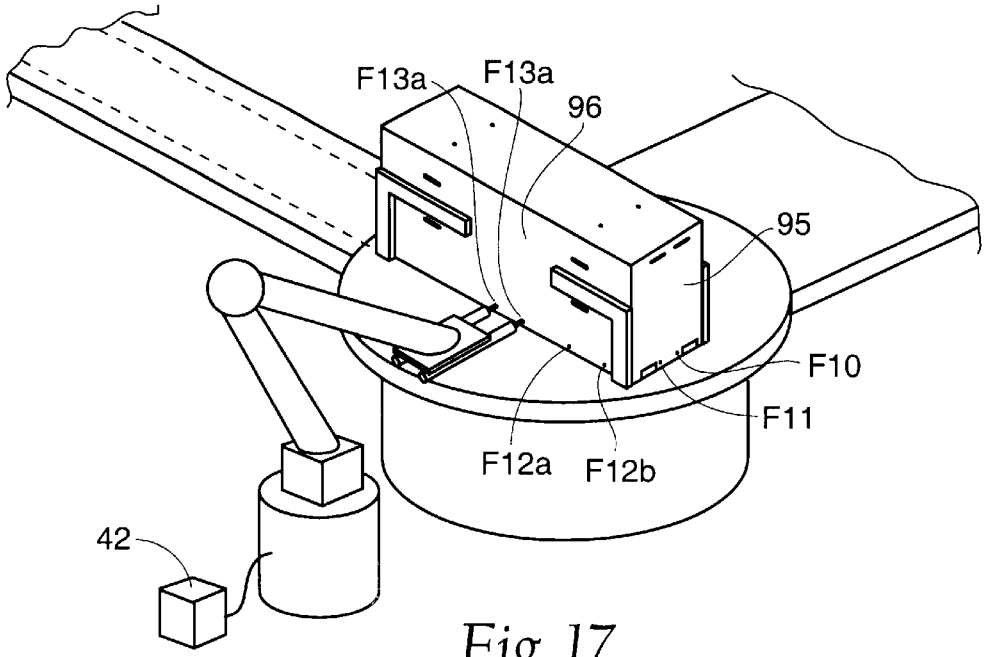
Figure 18:
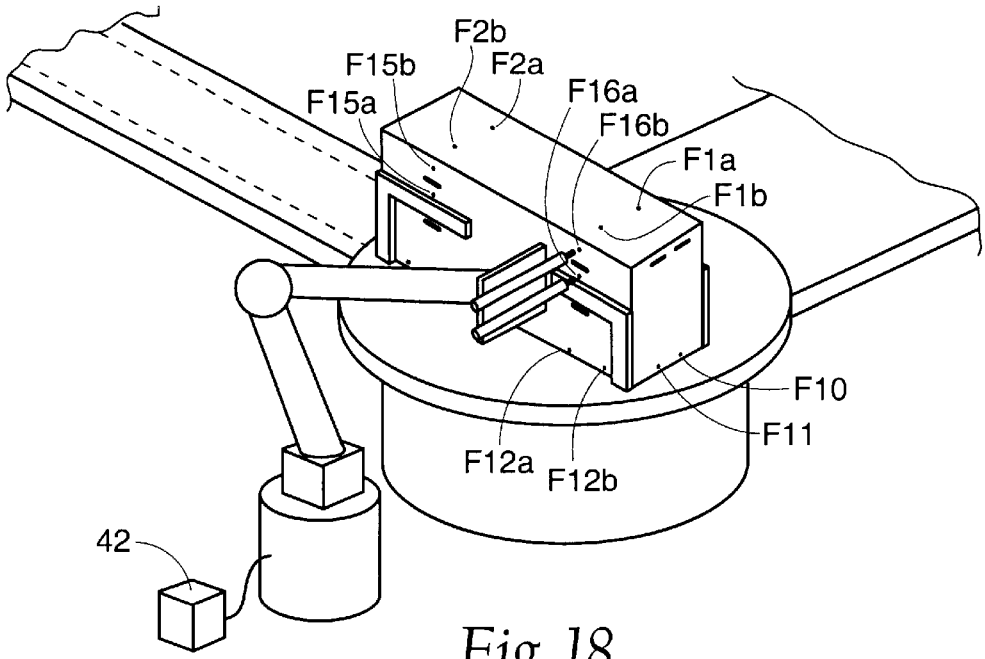
Figure 19:
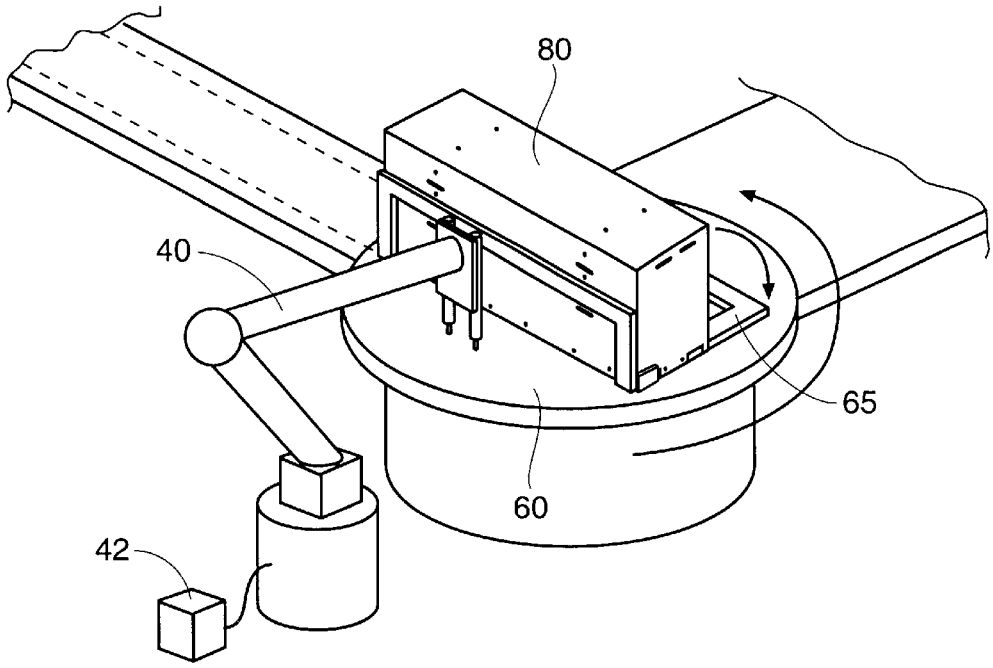

The robot then moves to a twelfth stop position, along the second side 96 of the crate assembly 80, and installs fasteners F12*a* and F12*b* into the pallet base 81, with fastener F12*a* passing through a structural upright 82. The robot moves to a thirteenth position, as shown in FIG. 17, and installs fasteners F13*a* and F13*b*. Fastener installation continues at the fourteenth, fifteenth and sixteenth stop positions, which correspond with stop positions seven, eight and nine on the first side 94 of the crate assembly 80. FIG. 18 depicts the robot 40 at the sixteenth stop position installing fasteners F16*a* and F16*b*. After the these fasteners are installed, a total of twenty-eight fasteners have been driven through the enclosure 87 and into either the pallet base 81, structural uprights 82, or both. The crate assembly 80 is now complete. The robot 40 again moves to a clear position, as illustrated in FIG. 19, and the turntable 60 rotates in the reverse direction, returning the crate assembly to its initial position.

Figure 20:
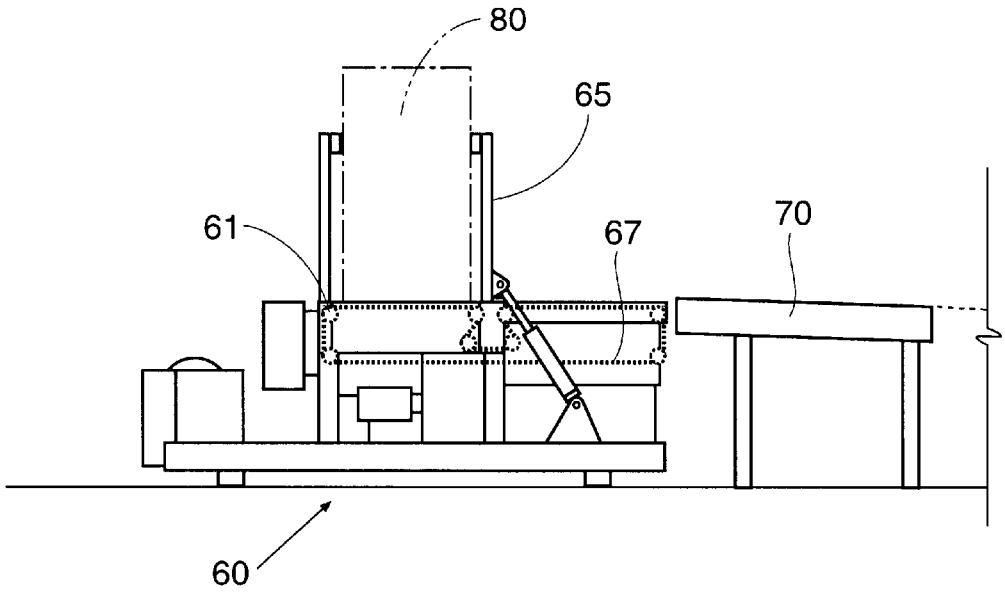
FIGS. 20 and 21 are side elevational views of the turntable assembly depicting the crate assembly being conveyed off the turntable.
Figure 21:
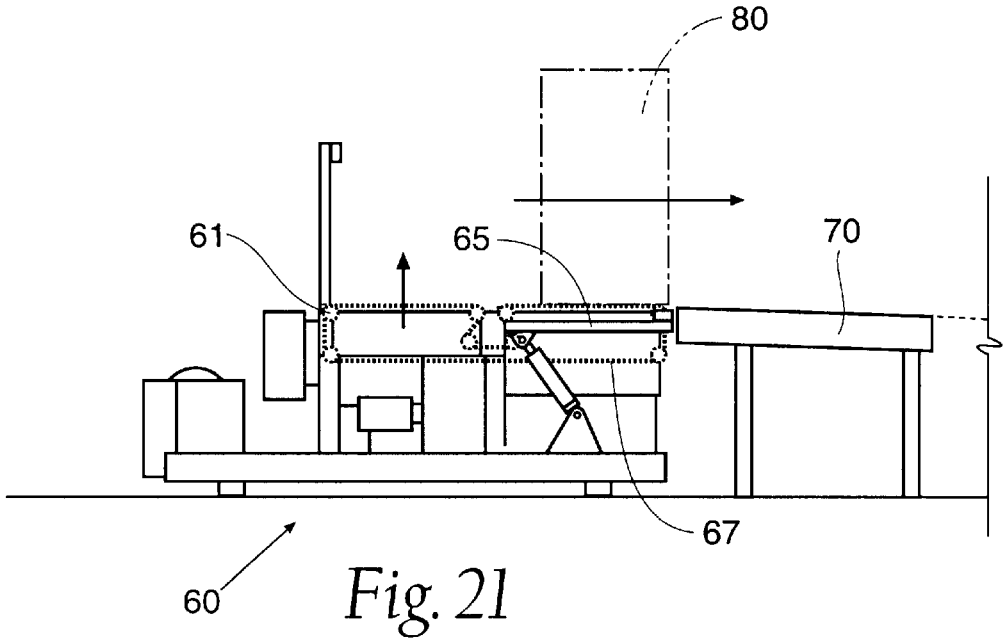

FIGS. 20 and 21 depict the crate assembly 80 being conveyed off of the turntable 60. The stabilization clamps 65 swing down and the crate 80 is lifted off the turntable 60 by the lift chain conveyor 61. The lift chain conveyor 61 is a powered chain transfer unit that uses an air-operated lift mechanism.

The entire lift chain conveyor 61 raises, lifting the crate assembly 80 off the turntable 60. A belt chain 76 that rotates in a continuous loop conveys the crate assembly 80 laterally until it rests on the exit conveyor 70. Crate assemblies 80 move down the exit conveyer 70 by gravity, and are positioned laterally to allow a greater number of crates to be stored on the exit conveyor before removal.

Figure 22:
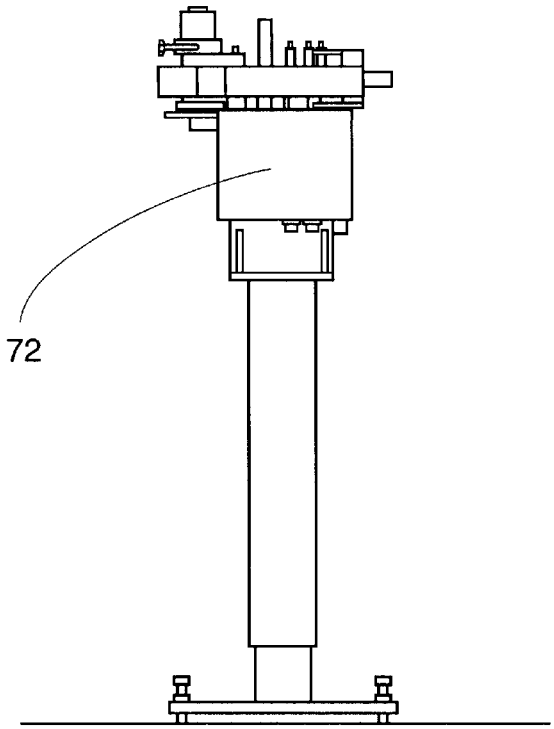
FIG. 22 depicts a side view of the label applicator of the present invention.
Figure 23:
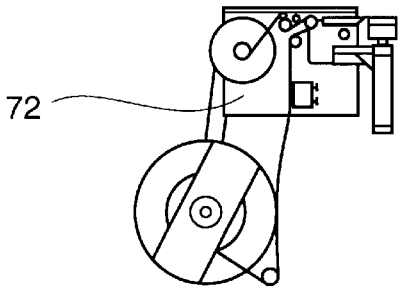
FIG. 23 depicts a top view label applicator of the present invention.

As shown in FIGS. 1 and 2, a label applicator 72 is located on the exit conveyor 70. If a fastener failure was detected during the fastening operation, a label is applied to the exiting crate 80 to signal the need for a manual inspection and correction. In the present embodiment, the label applicator 72 is a Universal L60. FIGS. 22 and 23 depict the present label applicator 72 in greater detail. The preferred label applicator 72 is manufactured by Universal Labeling Systems, Inc., of St. Petersburg, Fla.

The crate 80, with the supported object 83, leaves the robotic cell 30 ready for shipping. The multi-functional structural uprights 82 allow multiple crates 80 to be stacked without damage to the product. When the crate 80 and supported object 83 arrive at the "point of sale or delivery" destination, the fasteners 36 are preferably removed and the enclosure 87 and uprights 82 discarded. It should be noted that only a minimum number of fasteners 36 need be removed in order to uncrate the object 83. The pallet base 81 can return to the factory and be reused.

Figure 24:
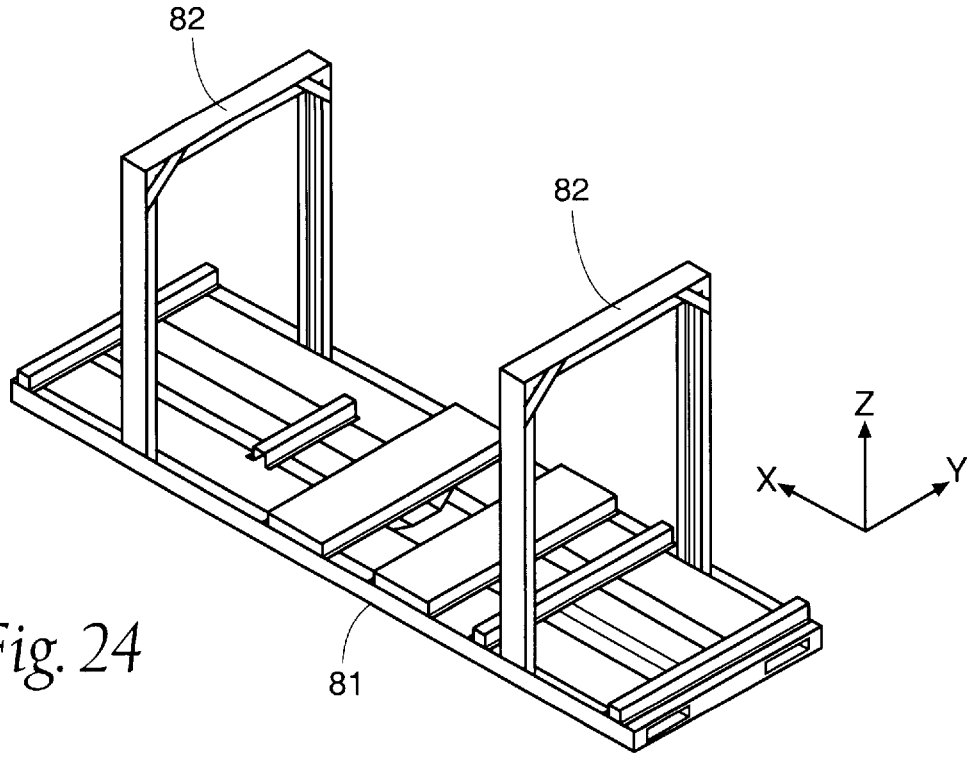
FIG. 24 is a perspective view of the pallet from slightly above.
Figure 25:
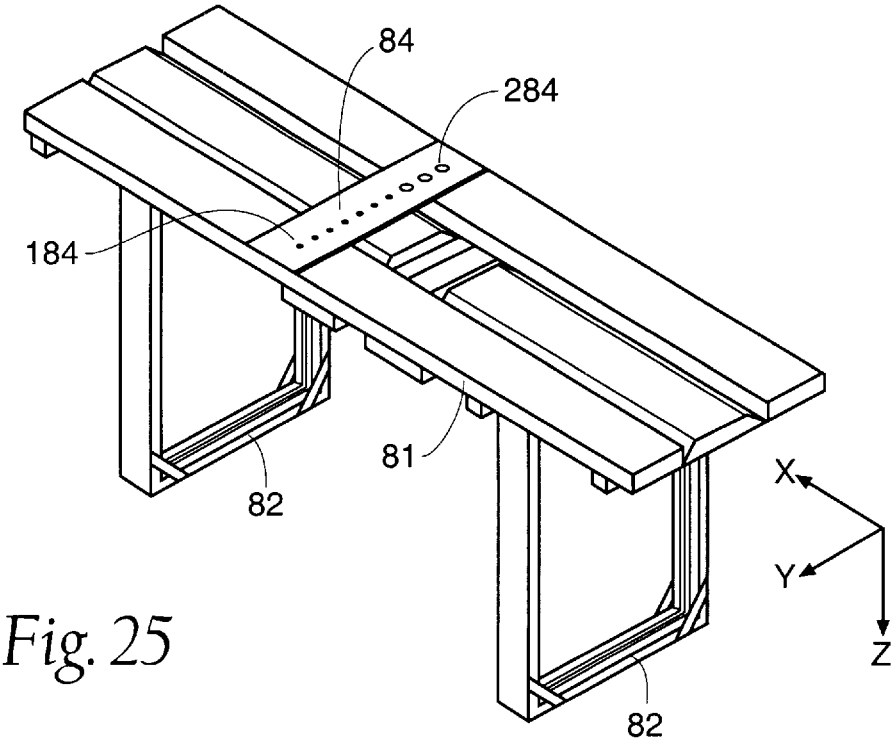
FIG. 25 is a perspective view of the pallet inverted to show the bottom thereof.

With particular reference to FIGS. 24 and 25, the preferred pallet base 81 and structural uprights 82 are depicted. A predetermined number of usage indicators 84, which may be formed on the pallet base 81 (see FIG. 25), correspond to the number of times the pallet base 81 may be used in a crate assembly 80 before it must be discarded. In the preferred embodiment, each usage indicator 84 is a predetermined location for an eventual use indication aperture 284 in the pallet base 81. Use indication apertures 284 are physically probed by the pallet usage sensor 54 on the infeed conveyor 50.

A new pallet base 81 comes with only one use indication aperture 284 formed therein. After it is used in a crate assembly 80, a second use indication aperture 284 is formed before the pallet base 81 is reused. In the present embodiment, there are ten possible usage indicators 84, which correspond to the ten times the present pallet base 81 may be used. The present embodiment also uses pilot holes 184, which are preformed into each usage indicator 84 location. The pilot holes 184 are small enough so as not to be detected by the pallet usage sensor 54. They are used to ensure proper placement of the use indication holes 284, which may be cut manually with a hole-cutting drill bit, or other suitable tool.

Figure 26:
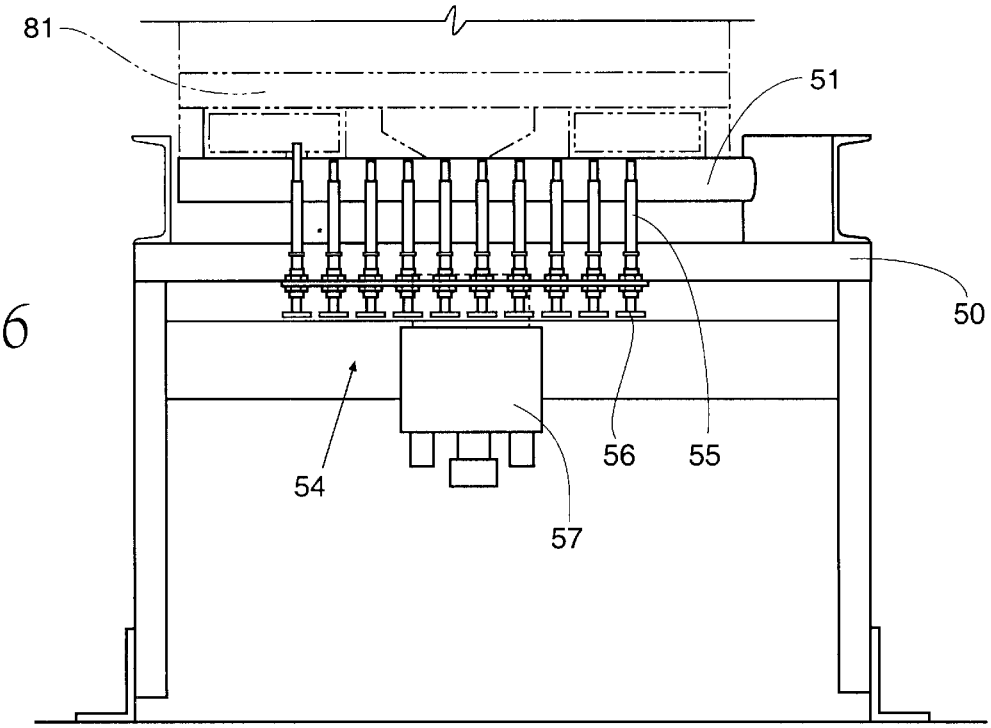
FIG. 26 is a cross-sectional view showing the pallet usage identification sensors, taken along line 26—26 of FIG. 2.
Figure 27:
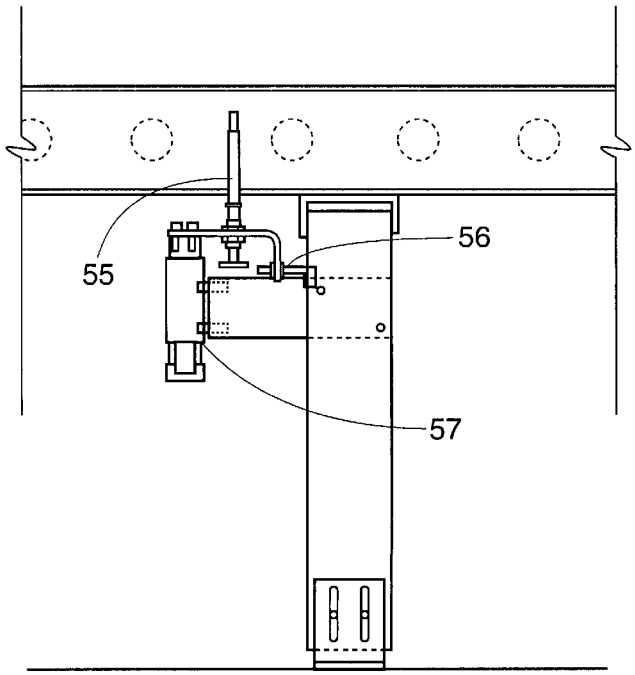
FIG. 27 is a side elevational view showing the pallet usage identification sensors.

With particular reference to FIGS. 26 and 27, the pallet usage sensor 54 comprises a plurality of spring-loaded probes 55, each having a proximity switch 56 and air-operated popup mechanism 57. The pallet usage sensor 54 is spaced a known distance from the infeed popup stop 52. When the crate assembly 80 is in place behind the infeed popup stop 52, the probes 55 align with the usage indicators 84 in the pallet base 81. The probes 55 attempt to pop up, and either pass through a usage indicator aperture 284 or are prevented by the absence of such an opening (pilot holes 184 are physically smaller than the probes 55, and do not allow passage). The proximity switches 56 sense the position of each probe and relay that information to the robot control system 42 for calibration of the robot 40.

Figure 28:
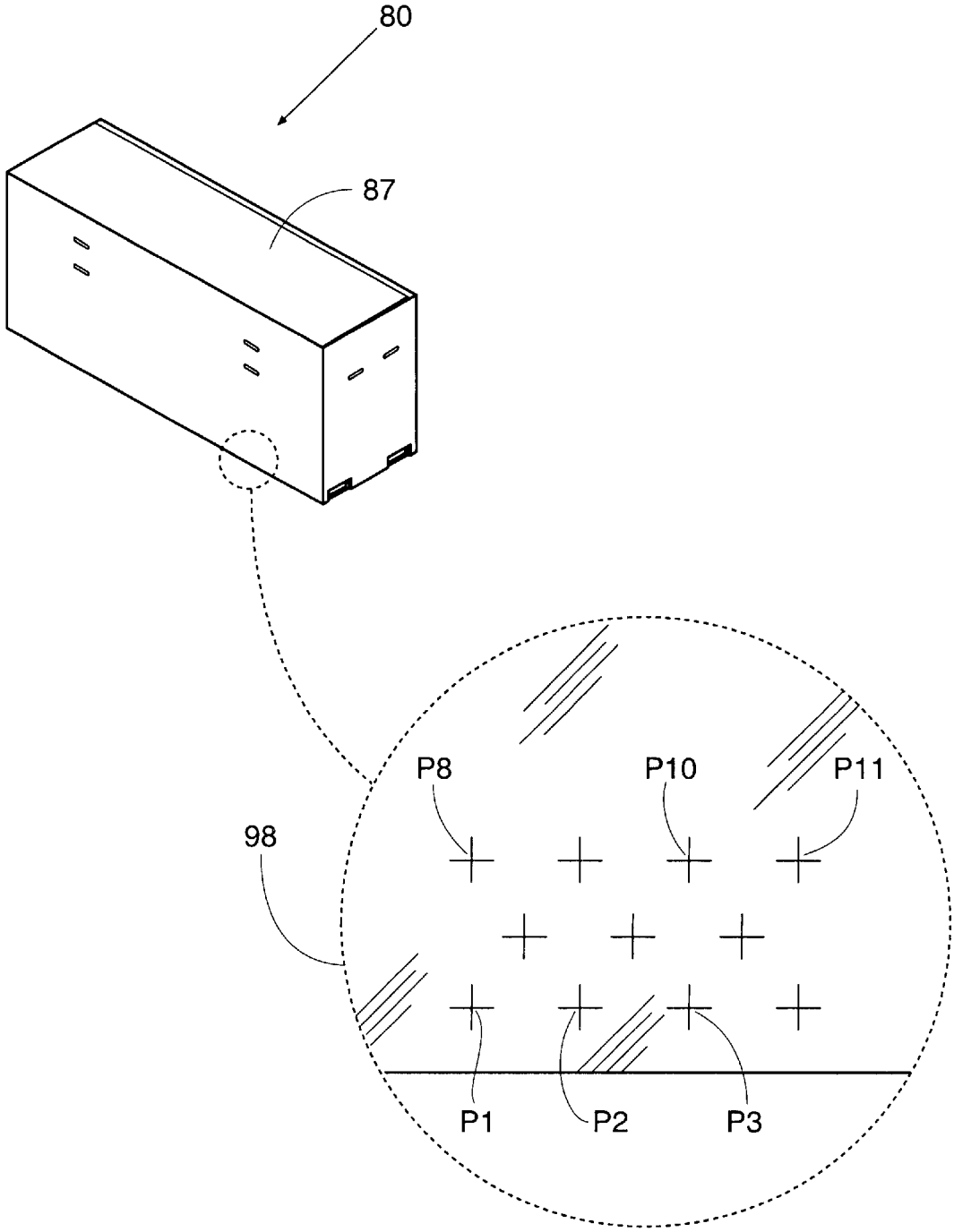
FIG. 28 depicts the arrangement of available fastener locations in a fastening zone of the present invention.

When a pallet base 81 is reused in a crate assembly 80, the new fasteners 36 in the pallet base 81 must be installed in slightly different locations than any previous fasteners. A previous fastener hole may not hold the new fastener securely, or old fasteners may have been left in the pallet base 81. For this reason, every previously mentioned fastener location in the pallet base 81 (F3–F7, F10–F14) is actually a zone comprising a plurality of possible pinpoint locations. In the present embodiment, a pattern of eleven possible pinpoint locations is available for each fastener in the pallet base 81. This pattern in a single fastening zone 98 is depicted by FIG. 28. Fasteners installed into the structural uprights 82 that do not penetrate the pallet base 81 may always be installed into the same position because new uprights 82 are used in every crate assembly 80. In other words, the fastening zone 98 exists primarily for fasteners installed into the pallet base 81.

A new pallet base 81 has one use indication aperture 284. When the pallet usage sensor 54 determines that only one hole exists, the robot 40 is calibrated to install fasteners into the first pinpoint location P1 in the fastening zone 98. If the pallet usage sensor 54 determines that two use indication apertures 284 exist, it is known that the first pinpoint location P1 has been previously used, and the robot 40 is calibrated to install fasteners into the second pinpoint location P2. This will continue until ten use indication apertures 284 exist, wherein the robot 40 installs fasteners into the tenth pinpoint location P10, and after which the pallet base 81 is discarded.

The eleventh pinpoint location P11 is provided as a backup location in case of fastener failure, and is available for a single use over the life of the pallet base 81. If a fastener failure is detected, the robot 40 will attempt to place an alternate fastener 36 in pinpoint location eleven and manual inspection will not be needed. Because the eleventh pinpoint location P11 is only available for one use, an attempt to install a fastener into an eleventh location that has been previously used will result in a fastener failure, and the crate assembly 80 will be labeled for manual inspection.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for securing a container to a pallet, said pallet having means for indicating prior use, said container having an open underside and a marginal end portion, said marginal end portion engageable with and overlaying said pallet and defining a surrounding fastening surface, said apparatus comprising:

means for communicating with said pallet prior use indicating means to determine prior pallet usage and generating a communication; and a robotic arm having a fastener driving device, said robotic arm having means to accept and interpret said communication in accordance with a pre-set program for installing fasteners in pre-selected unused portions of said fastening surface in accordance with said program and as affected by the input of said communication to said pre-set program.

2. The apparatus of claim 1 wherein said pallet prior use indicating means includes a predetermined number of apertures formed in said pallet, and said communicating means includes a plurality of mechanical probe devices arranged to be received in at least one of said apertures and generate said communication to detect prior usage of said pallet.

3. The apparatus of claim 1 further including a conveyor arranged to convey said pallet toward and away from said robotic arm.

4. The apparatus of claim 1 further including a rotary turntable arranged to support and rotate said pallet during fastener installation.

5. The apparatus of claim 1 wherein said fastener driving device comprises a pneumatic screwdriver.

6. The apparatus of claim 5 wherein the pneumatic screwdriver further includes a torque-controlling device.

7. The apparatus of claim 1 further comprising a fastener feeding mechanism connected to said fastener driving device for feeding fasteners to said device.

8. The apparatus of claim 1 wherein the communication of said means for communicating with said pallet prior use indicating means produces an electronic signal that is converted to define said pre-selected unused portions of said fastening surface.

* * * * *